US010960956B2

(12) United States Patent
Arendts

(10) Patent No.: US 10,960,956 B2
(45) Date of Patent: Mar. 30, 2021

(54) MAST-HEAD RIGGING CONNECTION DEVICE

(71) Applicant: James G. Arendts, Thayne, WY (US)

(72) Inventor: James G. Arendts, Thayne, WY (US)

( * ) Notice: Subject to any disclaimer, the term of this patent is extended or adjusted under 35 U.S.C. 154(b) by 0 days.

(21) Appl. No.: 16/271,812

(22) Filed: Feb. 9, 2019

(65) Prior Publication Data

US 2020/0255097 A1 Aug. 13, 2020

(51) Int. Cl.

| | |
|---|---|
| ***B63B 15/02*** | (2006.01) |
| ***B63H 9/08*** | (2006.01) |
| ***B63B 15/00*** | (2006.01) |
| ***B63H 9/10*** | (2006.01) |

(52) U.S. Cl.

CPC ..... *B63B 15/02* (2013.01); *B63B 15/00* (2013.01); *B63H 9/08* (2013.01); *B63H 9/10* (2013.01); *B63B 2015/0058* (2013.01); *B63H 2009/084* (2013.01)

(58) Field of Classification Search

CPC . B63B 15/02; B63B 15/00; B63B 2015/0058; B63H 9/10; B63H 9/08; B63H 2009/084

See application file for complete search history.

(56) References Cited

U.S. PATENT DOCUMENTS

| | | | | | |
|---|---|---|---|---|---|
| 2,107,303 | A * | 2/1938 | Ljungstrom | B63H 9/1035 | 114/106 |
| 3,580,203 | A * | 5/1971 | Martin | B63H 9/061 | 114/39.31 |
| 4,230,060 | A * | 10/1980 | McCoy | B63B 15/02 | 114/102.29 |
| 4,267,790 | A * | 5/1981 | Hood | B63H 9/1035 | 114/106 |
| 4,367,688 | A * | 1/1983 | Godfrey | B63B 15/0083 | 114/102.17 |
| 4,388,888 | A * | 6/1983 | Gushurst, Jr. | B63H 9/1092 | 114/90 |
| 4,480,570 | A * | 11/1984 | Rosenfield | B63H 9/1035 | 114/104 |
| 4,690,088 | A * | 9/1987 | Perini | B63H 9/061 | 114/102.14 |
| 4,723,499 | A * | 2/1988 | Furgang | B63H 9/1028 | 114/104 |
| 5,027,735 | A * | 7/1991 | Labrador | B01D 61/10 | 114/39.26 |
| 10,611,450 | B2 * | 4/2020 | Zenoz | B63H 9/08 | |

* cited by examiner

*Primary Examiner* — Anthony D Wiest

(57) ABSTRACT

One embodiment of a mast-head standing rigging connection device, allowing for sail module rotation about a mast axis, is disclosed. The embodiment allows for connection of shrouds and conventional single mast forestay and backstay rigging systems. Additional embodiments, utilizing modifications of the first embodiment, for multi-mast and triangular fore-aft sail mast roller reef-furl systems, are described.

3 Claims, 7 Drawing Sheets

MAST-HEAD RIGGING CONNECTION DEVICE

CROSS-REFERENCE TO RELATED APPLICATIONS

This is a division of U.S. patent Ser. No. 10/246,172, issued 2019 Apr. 2, the entire content of which is incorporated herein by reference.

PRIOR ART—REFERENCES

The following is a tabulation of some prior art that presently appears relevant:

U.S. Patents

| Pat. No. | Kind Code | Issue Date | Patentee |
|---|---|---|---|
| 2,107,303 | | 1938 Feb. 8 | Ljungström |
| 3,580,203 | | 1971 May 25 | Martin |
| 4,230,060 | | 1980 Oct. 28 | McCoy |
| 4,267,790 | | 1981 May 19 | Hood |
| 4,367,688 | | 1983 Jan. 11 | Godfrey |
| 4,388,888 | | 1983 Jun. 21 | Gushurst, Jr. |
| 4,480,570 | | 1984 Nov. 6 | Rosenfield et al. |

PRIOR ART—DISCUSSION

The cross-referenced U.S. patent discloses a wind sail design which includes a mast which is rigidly affixed to a ship or wind-propelled land vehicle. The first embodiment discloses a single sail module which rotates about the mast. For most applications, this embodiment would not require additional support provided by standing rigging. However, as disclosed in the cross-referenced patent, additional embodiments utilize two or more sail modules oriented about single masts. For these embodiments, standing rigging providing additional support is likely to be required.

A design for a mast-head mounted structure, which provides for standing rigging connection capability, is disclosed in the additional embodiments section of the cross-referenced application. The purpose of this divisional application is to provide full patent disclosure for a similar mast-head standing rigging connection device design.

The key requirement of the rigging connection device is to allow rotation, about the mast axis, of a sail assembly or fore-aft sail utilizing a mast reef-furl device while providing mast-head connection to conventional standing rigging (forestay, backstay, shrouds).

U.S. Pat. Nos. 4,267,790 and 4,480,570 disclose mast configurations where a conventional mainsail is reefed or furled by winding it on a rotatable mandrel whose axis is parallel to, but not co-linear with the structural mast axis. Due to this non co-linear configuration, conventional mast-head standing rigging connection devices are effective for this design.

U.S. Pat. Nos. 2,107,303, 3,580,203 and 4,367,688 disclose mast configurations where the entire mast rotates about its axis. However, none of these designs provide for standing rigging support.

Designs which encompass both standing rigging and a rotatable mast are disclosed in U.S. Pat. Nos. 4,230,060 and 4,388,888. The former patent discloses a mast-head rigging device which contains guide pulleys for running rigging and tangs for standing rigging connections. However, the device back-stay connection geometry allows for only triangular mainsail configurations. U.S. Pat. No. 4,388,888 discloses a sail system consisting of rotating mast, rectangular sail and two mast-head standing rigging connection devices. One connection device design allows for angled forestay and horizontal backstay connections. The other connection device design allows for only horizontal forestay connection. Neither device accommodates shroud connections.

It is observed that none of the existing patent designs discussed above have general standing rigging connection capabilities for rectangular or triangular fore-aft sail configurations. Required general rigging connection capabilities may be summarized:

General angled or angled-to-deck forestay,

General angled or angled-to-deck backstay,

Shrouds (one or more for both starboard and port sides).

SUMMARY

A new mast-head standing rigging connection device design is disclosed which encompasses the capabilities outlined above. The device is affixed to the top of a mast, about which a sail assembly or sail mast reef-furl system may rotate. For rigging systems which include shrouds, connection lugs are provided for two or more shrouds. Connection lugs are provided for both forestay and backstay. These lugs are located at the ends of beams, the lengths of which are determined by sail geometry and forestay or backstay vertical angle. Both forestay and backstay beams are attached to the central part of the connection device assembly.

Advantages

The mast-head standing rigging connection device, when used with rotatable sail assembly or fore-aft sail mast reef-furl system, has the following advantages:

(a) General standing rigging configurations are accommodated, including two or more shrouds, a forestay and backstay, (b) Frictional torque, induced by rotation of sail assembly or reef-furl system, is minimized due to inclusion of roller- and ball-bearings in design, (c) For sail rigs with two or more masts and/or two or more sail levels or sail modules, complicated standing rigging layouts may be accommodated.

DRAWINGS—FIGURES

In the drawings, closely related figures have the same number but differing alphabetical suffixes.

Figure 1:
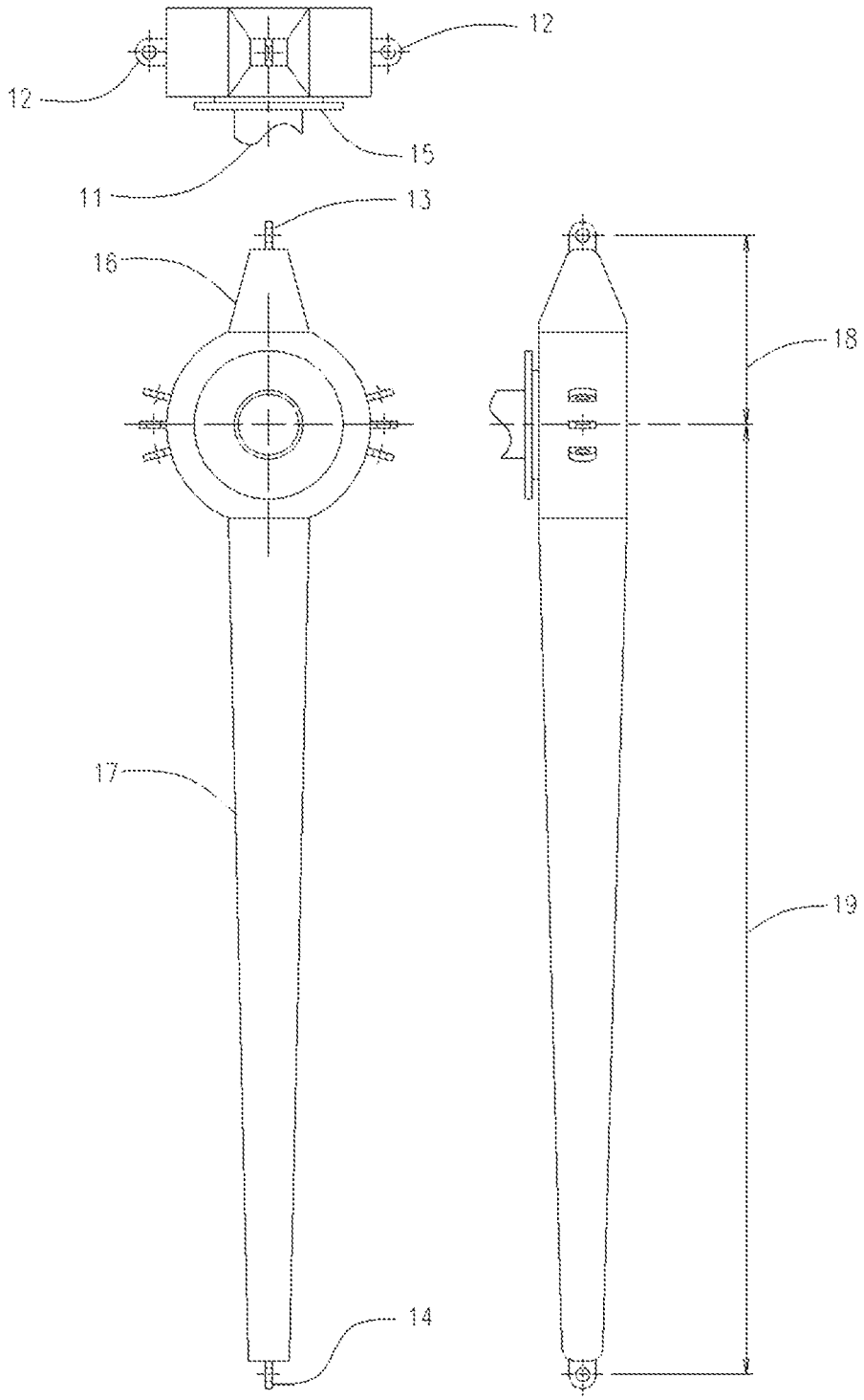
FIG. 1 illustrates the first embodiment exterior overall views.

| Drawings - Reference Numerals | |
|---|---|
| 11 mast | 12 shroud attachment lug |
| 13 forestay attachment lug | 14 backstay attachment lug |
| 15 rotatable sail module connection flange | 16 forestay connection beam |
| 17 backstay connection beam | 18 forestay - sail clearance dimension |
| 19 backstay - sail clearance dimension | 21 ball bearing |
| 22 tapered roller bearing | 23 bearing support cylinder |
| 24 mast connection flange | 25 central barrel |
| 26 top cover | 27 bottom cover |
| 31 first embodiment assembly | 32 double sail module assembly |
| 33 forestay | 34 backstay |
| 35 typical shroud | 51 typical first embodiment device |
| 52 typical second embodiment device | 53 typical third embodiment device |

EMBODIMENT DETAILED DESCRIPTIONS

Figure 2A:
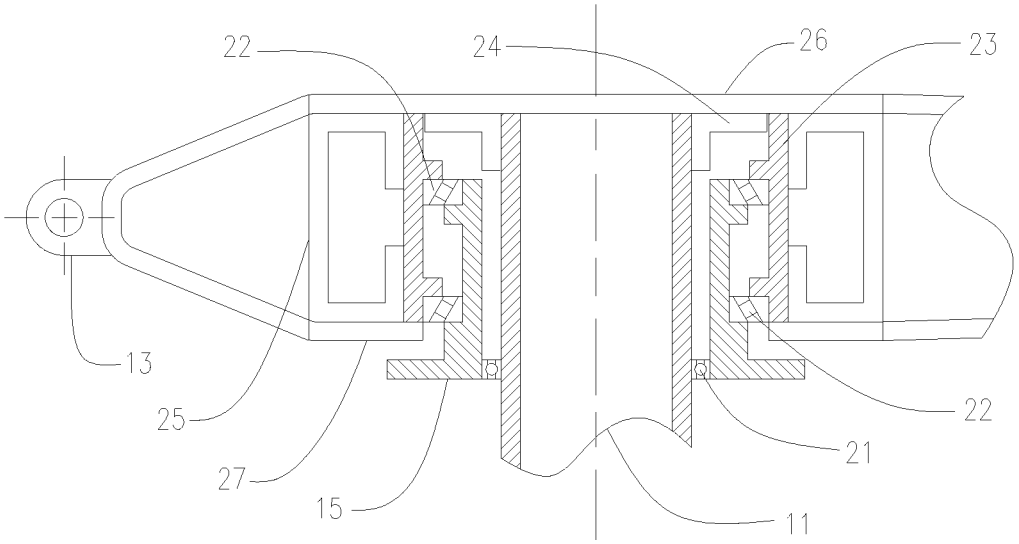
FIGS. 2A and 2B illustrate the first embodiment cross-section details.
Figure 2B:
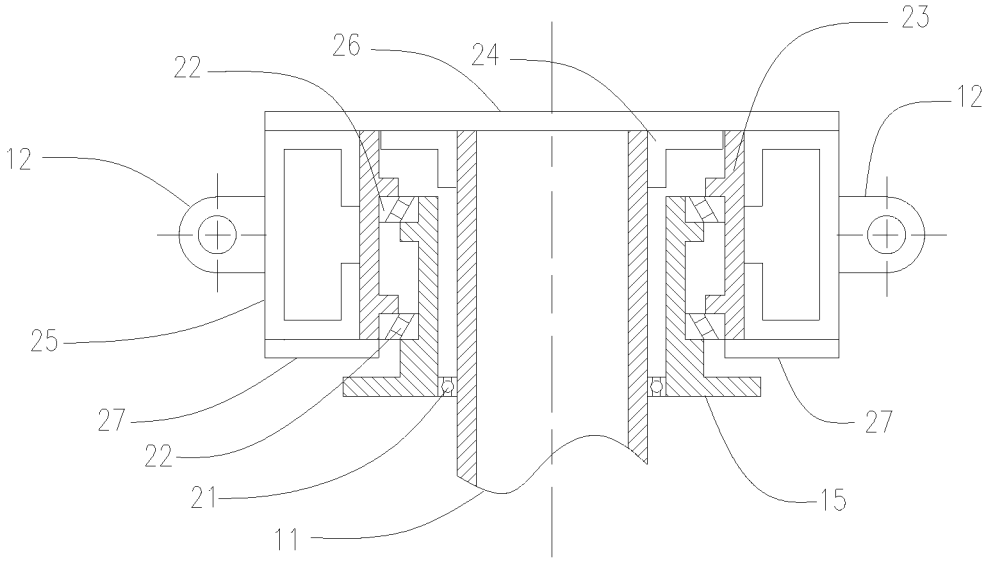
Figure 3:
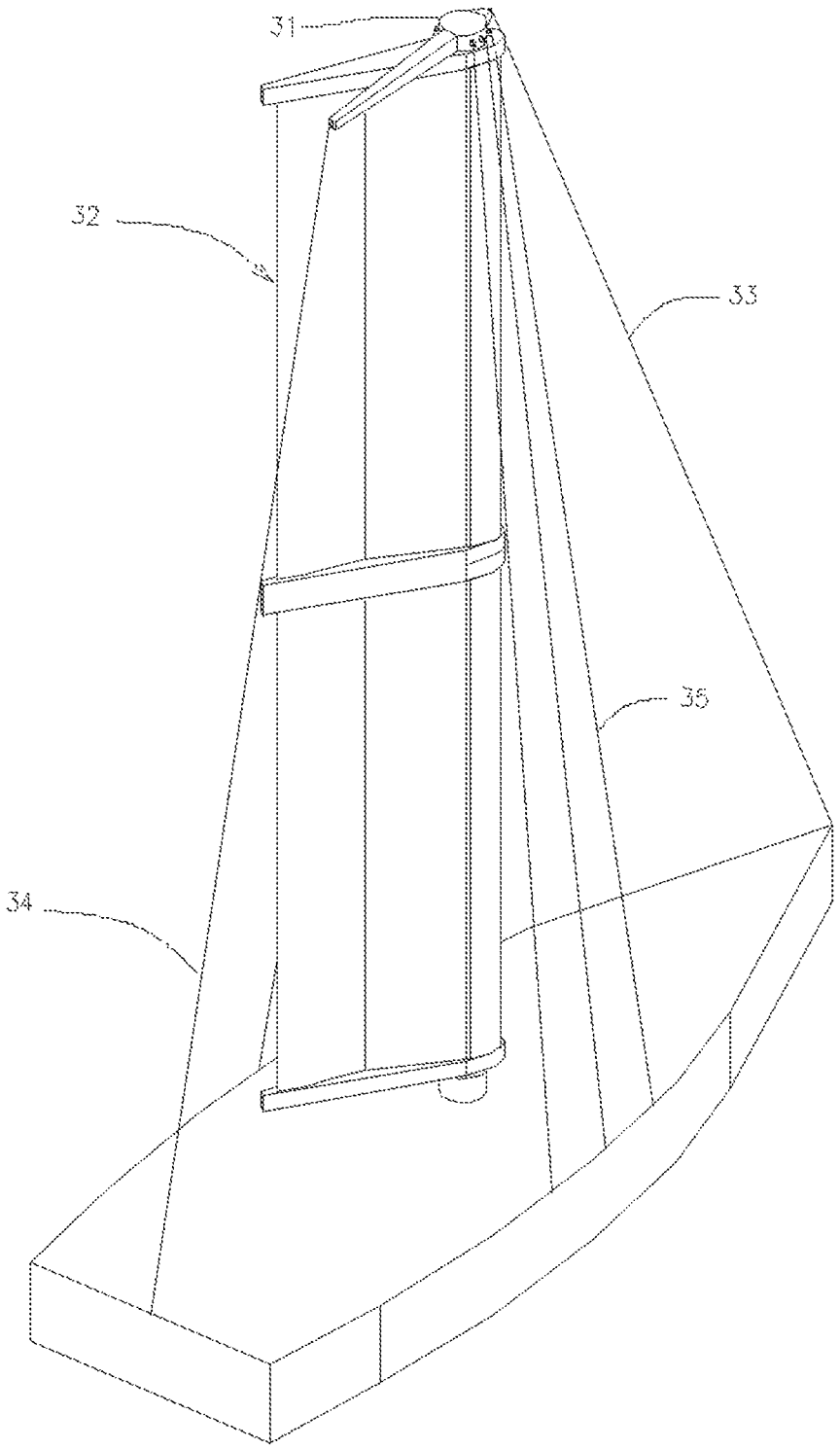
FIG. 3 illustrates use of the first embodiment in a conceptual high performance yacht utilizing a double sail module assembly.

First Embodiment—FIGS. 1 Through 3

The purpose of the embodiment is to provide support of the mast-head by means of conventional standing rigging while allowing rotation, about the mast axis, of a sail module, as described in the cross-reference. FIGS. 1 through 2B contain depictions of a mast 11. The mast is not a part of the embodiment, but is included in the figures to illustrate interaction of the embodiment with the mast.

FIG. 1 illustrates three exterior orthographic views of the first embodiment. The forestay and backstay connection beams 16 and 17, respectively, have box cross-sections and transmit forestay and backstay rigging forces to the central part of the embodiment:

central barrel 25, bearing support cylinder 23 and mast connection flange 24, as detailed in FIGS. 2A and 2B. Forestay and backstay connection lugs 13 and 14 are welded to the ends of the beams. Lengths of the beams, 18, 19, are determined from actual sail module dimensions so as to provide clearance between fore- and back-stays and the sail module. Also shown in FIG. 1 are shroud connection lugs 12 welded to the central barrel.

Also shown in FIGS. 1 through 2B is the rotatable assembly connection flange 15. It is free to rotate about the mast 11 axis and interacts with the remainder of the first embodiment through two tapered roller bearings 22 and bearing support cylinder 23. Stability of the embodiment is enhanced through use of the ball bearing 21 located between flange 15 and mast 11.

As illustrated in FIGS. 2A and 2B, the first embodiment is secured to the mast by the mast connection flange 24. This ensures that the embodiment remains aligned with the watercraft or land vehicle during sail module rotation about the mast axis.

First Embodiment—Construction and Operation

Construction of this embodiment is straightforward, with no requirements for specialized equipment, and could be accomplished in a well-equipped machine shop. Due to its strength, weldability and corrosion resistance, high strength aluminum alloy is an ideal material for the majority of the embodiment. However, for the highly stressed regions: bearings 21 and 22, rotatable assembly connection flange 15 and bearing support cylinder 23 adjacent to bearings 21 and 22, use of high strength carbon steel is suitable.

FIG. 3 illustrates use of the first embodiment 31 for a hypothetical high performance yacht where a double sail module assembly 32 is utilized on a single mast. Shown are the following standing rigging components: forestay 33, backstay 34 and shrouds 35.

Additional Embodiments—FIGS. 4 Through 7

Two additional embodiments, based on modifications of the first embodiment are described herein.

Figure 4:
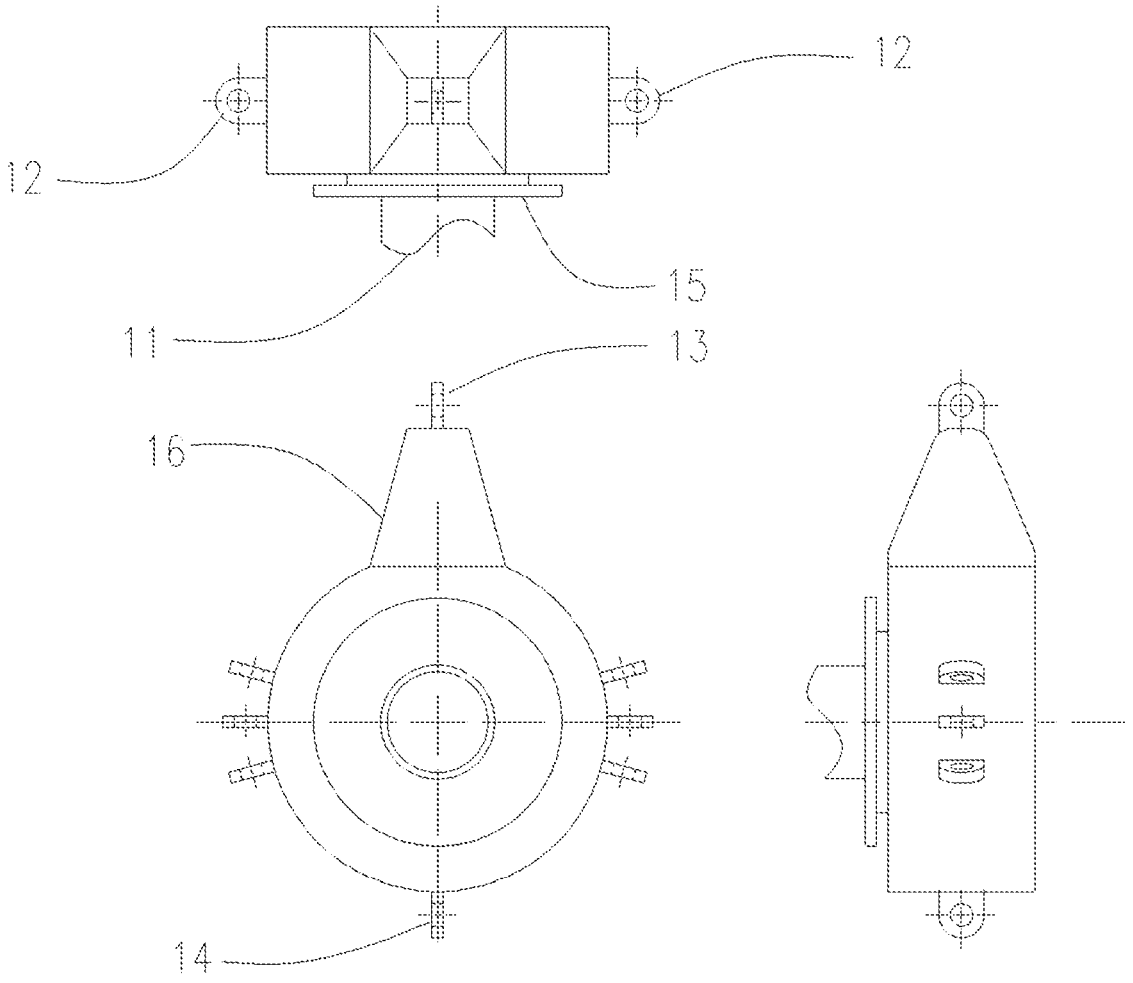
FIG. 4 shows the second embodiment exterior overall views.
Figure 5:
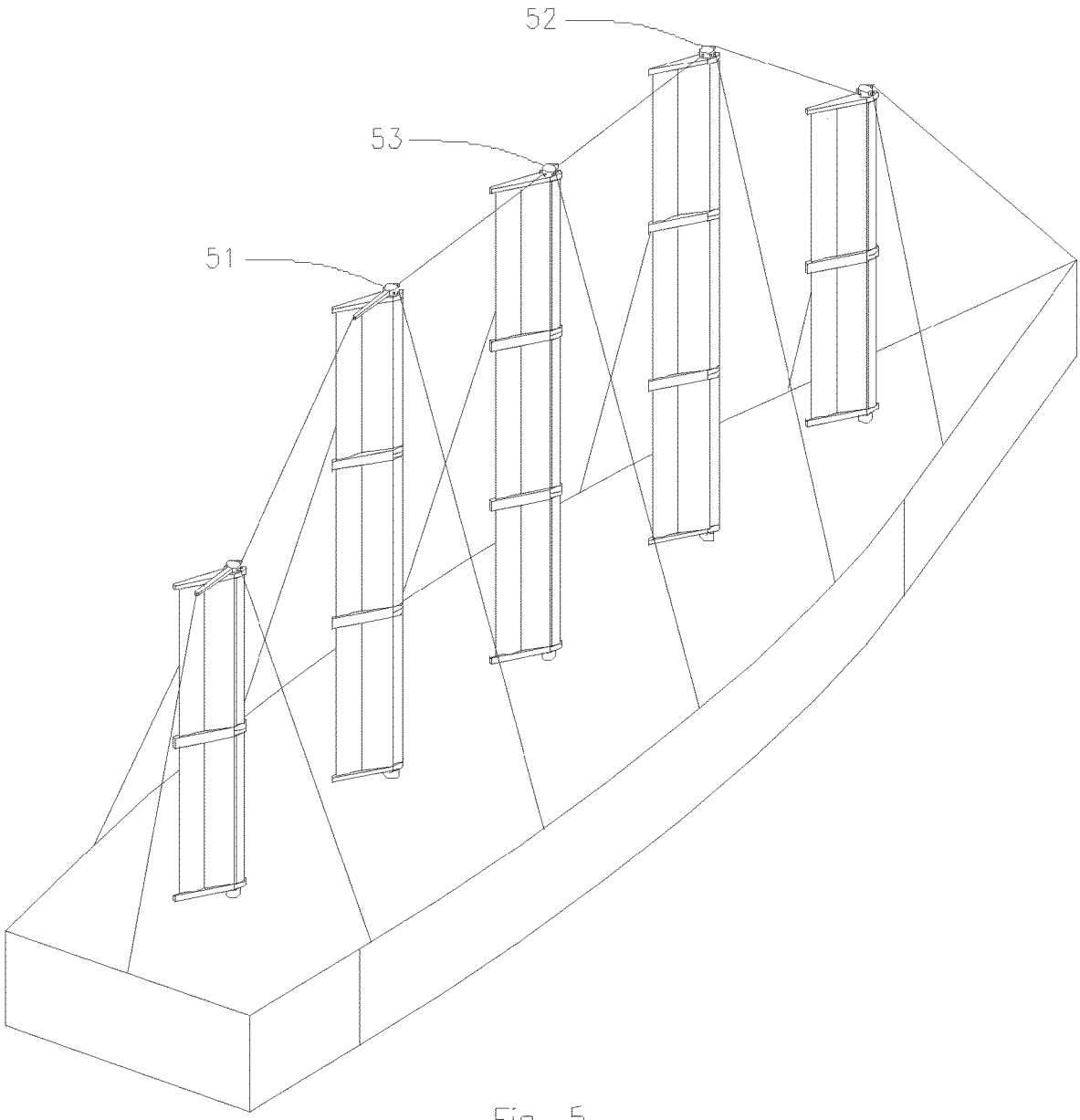
FIG. 5 illustrates use of both first and second embodiments in a conceptual purpose-built sailing craft.

Second Embodiment, Multi-Mast Application—FIGS. 4 and 5

For multi-mast sail rigs, for a given mast, a mast-head backstay may be oriented either horizontally or angled upward from horizontal. Thus, the backstay connection beam 17 may be removed for these applications. FIG. 4 shows exterior views of the second embodiment which contains no backstay connection beam. In this case the backstay attachment lug 14 is welded directly to the central barrel 25 portion of the embodiment. All other parts of the second embodiment are identical to those of the first embodiment. It is noted that bending moments imparted to the mast, induced by backstay forces, are reduced for the second embodiment.

FIG. 5 illustrates a conceptual five-mast sailing vessel, utilizing multi-module sails, where both first embodiment 51 and second embodiment 52 mast-head standing rigging connection devices are utilized.

Figure 6:
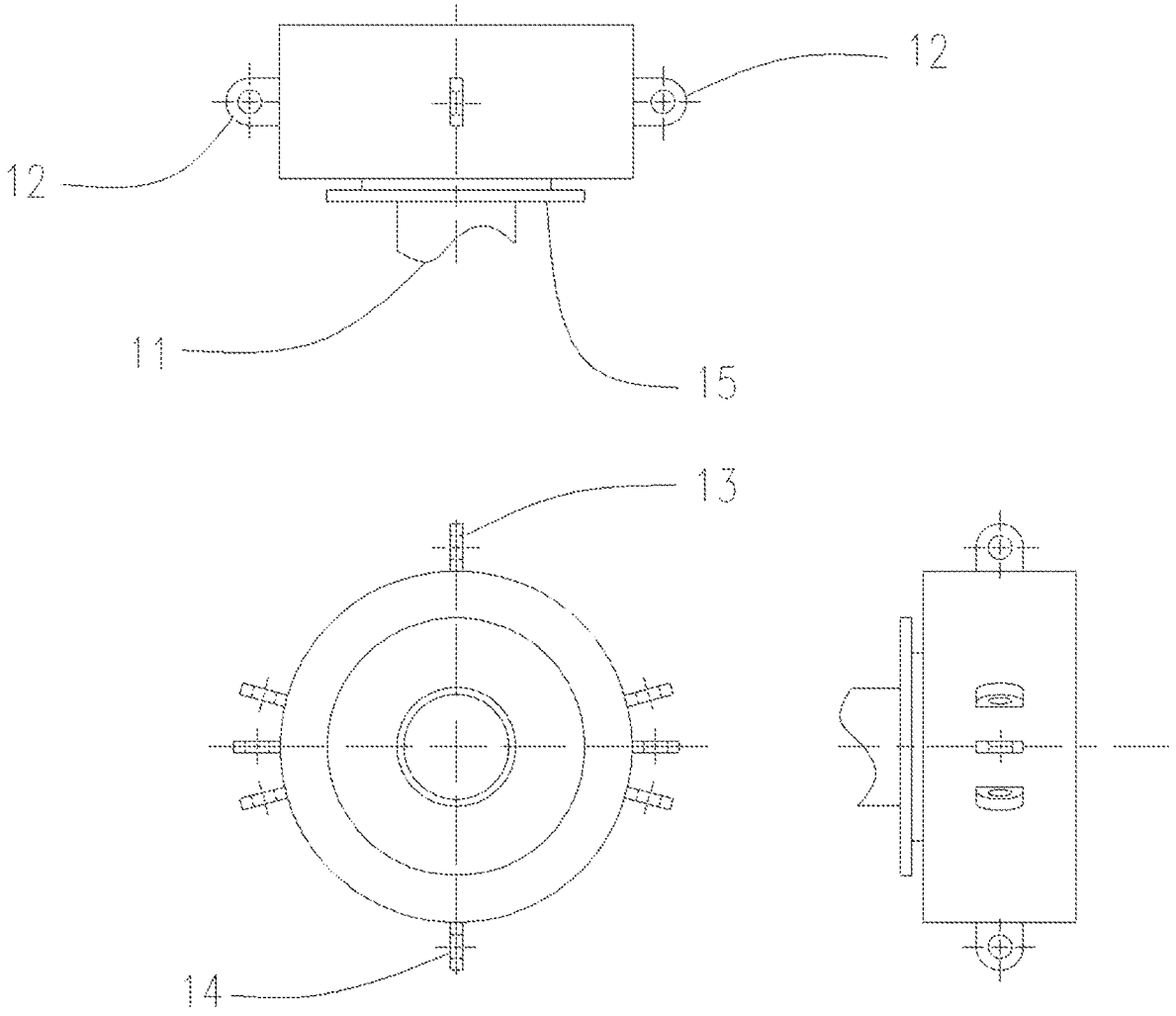
FIG. 6 shows the third embodiment exterior overall views.
Figure 7:
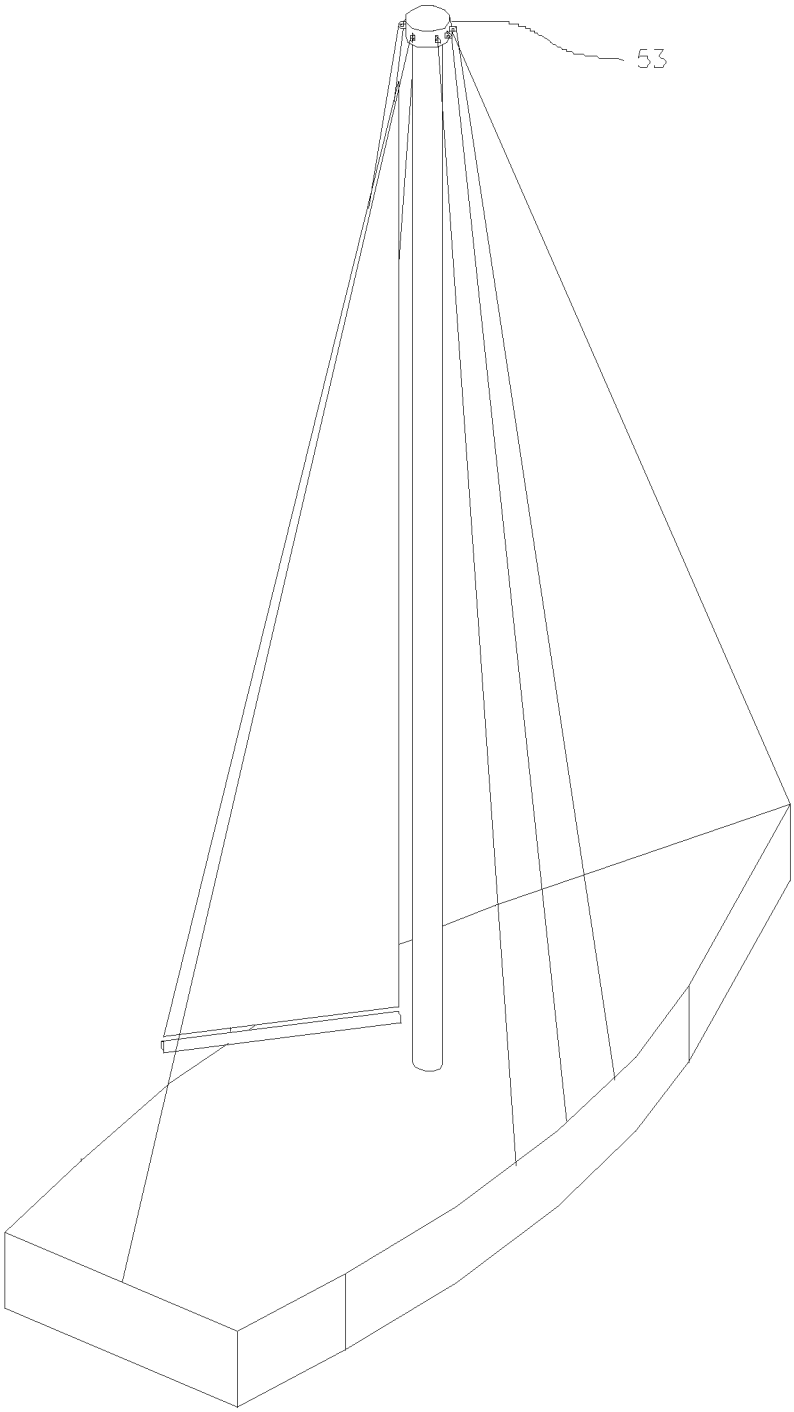
FIG. 7 illustrates use of the third embodiment in a conceptual yacht utilizing a mast roller reef-furl triangular fore-aft mainsail.

Third Embodiment, Triangular Fore-Aft Sail Application—FIGS. 5 Through 7

An additional third embodiment follows from a further modification of the first embodiment for applications where both forestay and backstay do not interfere with sail module rotation where both forestay and backstay connection beams are removed as a third embodiment 53. Exterior views of the third embodiment, FIG. 6. Here, all stay connection lugs, 12, 13 and 14, are welded directly to the central barrel portion of the embodiment. Interior details of the third embodiment central section are identical to those shown in FIG. 2. Use of this embodiment is shown in FIG. 5, in addition to first and second embodiments.

This embodiment may also be utilized for conventional triangular fore-aft sails. FIG. 7 illustrates use of the third embodiment 53 for a conceptual single-mast vessel with triangular fore-aft sail. Here, use of the third embodiment would be utilized if a mainsail mast roller reef-furl system is utilized.

Embodiments—Advantages

Advantages evident in the embodiments described above are:

(a) The embodiments apply to a large range of standing rigging configurations.

(b) Use of roller and ball bearings in the embodiments' designs allow for very low friction operation of attached rotating sail systems.

(c) Embodiments may be utilized for both modular rectangular fore-aft sail systems and conventional triangular fore-aft sail rotational reef-furl designs.

Conclusion, Ramifications and Scope

A mast-head standing rigging connection device design has been disclosed. This design is simple in concept and construction, with the following capabilities:

it provides a simple method for stabilization of masts supporting rotatable sail modules or conventional sail roller mast reef-furl systems;

it accommodates a wide variety of standing rigging configurations;

rotatable sail modules and roller mast reef-furl systems are both supported.

I claim:

1. A mast-head standing rigging connection device, providing forestay, backstay and shroud structural support to a mast-head, and allowing for sail module or triangular sail mast roller reef-furl system rotation about a mast axis, comprising:

a. a non-rotating assembly, rigidly connected to top of said mast, comprising:

1. a mast connection flange (24) attached to said mast,
2. a top cover (26) attached to said mast connection flange,
3. a central barrel (25) attached to said top cover,
4. a bottom cover (27) attached to said central barrel,
5. a bearing support cylinder (23) attached to said central barrel,
6. a forestay connection beam (16) attached to said top cover and said bottom cover and oriented in the fore-aft direction,
7. a backstay connection beam (17) attached to said top cover and said bottom cover, oriented in the fore-aft direction and opposed to said forestay connection beam,
8. a plurality of shroud attachment lugs (12) attached to opposing sides of said central barrel, and located between said forestay connection beam and said backstay connection beam,
9. a forestay attachment lug (13) attached to the forward end of said forestay connection beam,
10. a backstay attachment lug (14) attached to backward end of said backstay connection beam;

b. an assembly, rotatable about said mast axis, comprising:

1. a rotatable sail module connection flange (15) connected to said sail module or said triangular sail mast roller reef-furl system,
2. a first bearing (21) providing radial, in the direction ninety degrees to said mast axis, force transmission between said rotatable sail module connection flange and said mast,
3. a second bearing (22) providing radial, in the direction ninety degrees to said mast axis, and axial, in the direction said mast axis, force transmission between said rotatable sail module connection flange and said bearing support cylinder,
4. a third bearing (22) providing radial, in the direction ninety degrees to said mast axis, and axial, in the direction said mast axis, force transmission between said rotatable sail module connection flange and said bearing support cylinder;

whereby, upon connection of said standing rigging to one or more of said attachment lugs (12)(13)(14), and connection of said sail module or said triangular sail mast roller reef-furl system to said rotatable sail module connection flange (15), rotation, about said mast axis, of said sail module or said triangular sail mast roller reef-furl system is available whilst said standing rigging support of said mast is enabled.

2. A mast-head standing rigging connection device, providing forestay, backstay and shroud structural support to a mast-head, and allowing for sail module or triangular sail mast roller reef-furl system rotation about a mast axis, comprising:

a. a non-rotating assembly, rigidly connected to top of said mast, comprising:

1. a mast connection flange (24) attached to said mast,
2. a top cover (26) attached to said mast connection flange,
3. a central barrel (25) attached to said top cover,
4. a bottom cover (27) attached to said central barrel,
5. a bearing support cylinder (23) attached to said central barrel,
6. a forestay connection beam (16) attached to said top cover and said bottom cover and oriented in the fore-aft direction,
7. a plurality of shroud attachment lugs (12) attached to opposing sides of said central barrel, and located on a starboard-port axis,
8. a forestay attachment lug (13) attached to the forward end of said forestay connection beam,
9. a backstay attachment lug (14) attached to said central barrel located opposite said forestay connection beam;

b. an assembly, rotatable about said mast axis, comprising:

1. a rotatable sail module connection flange (15) connected to said sail module or said triangular sail mast roller reef-furl system,
2. a first bearing (21) providing radial, in the direction ninety degrees to said mast axis, force transmission between said rotatable sail module connection flange and said mast,
3. a second bearing (22) providing radial, in the direction ninety degrees to said mast axis, and axial, in the direction said mast axis, force transmission between said rotatable sail module connection flange and said bearing support cylinder,
4. a third bearing (22) providing radial, in the direction ninety degrees to said mast axis, and axial, in the direction said mast axis, force transmission between said rotatable sail module connection flange and said bearing support cylinder;

whereby, upon connection of said standing rigging to one or more of said attachment lugs (12)(13)(14), and connection of said sail module or said triangular sail mast roller reef-furl system to said rotatable sail module connection flange (15), rotation, about said mast axis, of said sail module or said triangular sail mast roller reef-furl system is available whilst said standing rigging support of said mast is enabled.

3. A mast-head standing rigging connection device, providing forestay, backstay and shroud structural support to a mast-head, and allowing for triangular sail mast roller reef-furl system rotation about a mast axis, comprising:

a. a non-rotating assembly, rigidly connected to top of said mast, comprising:

1. a mast connection flange (24) attached to said mast,
2. a top cover (26) attached to said mast connection flange,
3. a central barrel (25) attached to said top cover,
4. a bottom cover (27) attached to said central barrel,
5. a bearing support cylinder (23) attached to said central barrel,
6. a plurality of shroud attachment lugs (12) attached to opposing sides of said central barrel, and located on a starboard-port axis,
7. a forestay attachment lug (13) attached to said central barrel and located on the forward fore-aft axis, 8. a backstay attachment lug (14) attached to said central barrel and located on the backward fore-aft axis;

b. an assembly, rotatable about said mast axis, comprising:

1. a rotatable sail module connection flange (15) connected to said triangular sail mast roller reef-furl system,
2. a first bearing (21) providing radial, in the direction ninety degrees to said mast axis, force transmission between said rotatable sail module connection flange and said mast,
3. a second bearing (22) providing radial, in the direction ninety degrees to said mast axis, and axial, in the direction said mast axis, force transmission between said rotatable sail module connection flange and said bearing support cylinder,
4. a third bearing (22) providing radial, in the direction ninety degrees to said mast axis, and axial, in the direction said mast axis, force transmission between said rotatable sail module connection flange and said bearing support cylinder;

whereby, upon connection of said standing rigging to one or more of said attachment lugs (12)(13)(14), and connection of said triangular sail mast roller reef-furl system to said rotatable sail module connection flange (15), rotation, about said mast axis, of said triangular sail mast roller reef-furl system is available whilst said standing rigging support of said mast is enabled.

* * * * *